US006931898B2

(12) United States Patent
Wendt

(10) Patent No.: US 6,931,898 B2
(45) Date of Patent: Aug. 23, 2005

(54) TOOL FOR RELEASING A LOCKING CYLINDER

(76) Inventor: Adalbert Wendt, Sonnenhang 17, 50127 Bergheim (DE)

( * ) Notice: Subject to any disclaimer, the term of this patent is extended or adjusted under 35 U.S.C. 154(b) by 0 days.

(21) Appl. No.: 10/148,490

(22) PCT Filed: May 30, 2001

(86) PCT No.: PCT/EP01/06122

§ 371 (c)(1),
(2), (4) Date: Sep. 4, 2002

(87) PCT Pub. No.: WO02/29185

PCT Pub. Date: Apr. 11, 2002

(65) Prior Publication Data

US 2003/0101782 A1 Jun. 5, 2003

(51) Int. Cl.[7] ..... E05B 19/20
(52) U.S. Cl. ..... 70/394; 70/397; 70/405
(58) Field of Search ..... 70/394, 395, 397, 70/398, 400, 393, 401, 405

(56) References Cited

U.S. PATENT DOCUMENTS

| | | | | | |
|---|---|---|---|---|---|
| 1,639,919 | A | * | 8/1927 | Baron | 70/394 |
| 4,838,061 | A | * | 6/1989 | Tai-Seng | 70/493 |
| 5,355,702 | A | * | 10/1994 | Escribens | 70/395 |
| 5,372,024 | A | * | 12/1994 | Ruckert | 70/406 |
| 6,041,629 | A | * | 3/2000 | Hughes | 70/394 |
| 6,134,928 | A | | 10/2000 | Kang | 70/394 |
| 6,148,652 | A | * | 11/2000 | Magini et al. | 70/394 |
| 6,272,891 | B1 | * | 8/2001 | Moen | 70/428 |
| 6,305,200 | B1 | * | 10/2001 | Moen | 70/428 |

FOREIGN PATENT DOCUMENTS

| | | |
|---|---|---|
| DE | 298 08 888 U | 9/1999 |
| DE | 198 49 874 A | 10/1999 |

* cited by examiner

*Primary Examiner*—John B. Walsh
(74) *Attorney, Agent, or Firm*—Venable LLP; Robert Kinberg; Catherine M. Voorhees

(57) ABSTRACT

A tool for unlocking a locking cylinder, with a tumbler consisting of a plurality of spring-loaded locking bodes that can be displaced crosswise to the rotational axis of the locking cylinder. The tool comprises a rotating part (1) provided with two driver noses (10) on its cylinder side end, which can be inserted into the keyway. The tool furthermore comprises a sliding part (4) that is positioned such that it is connected form-locking to the rotating part 91) in the rotating direction and axially movable in the axial direction and has a flat sensing element (6) on the cylinder-side end that can be inserted into the keyway. The cross-sectional profile of the sensing element corresponds at least in some sections to the cross-sectional profile of the keyway, wherein at least one sensing body (9) for displacing the locking body inside the locking cylinder is assigned to the sensing element.

15 Claims, 2 Drawing Sheets

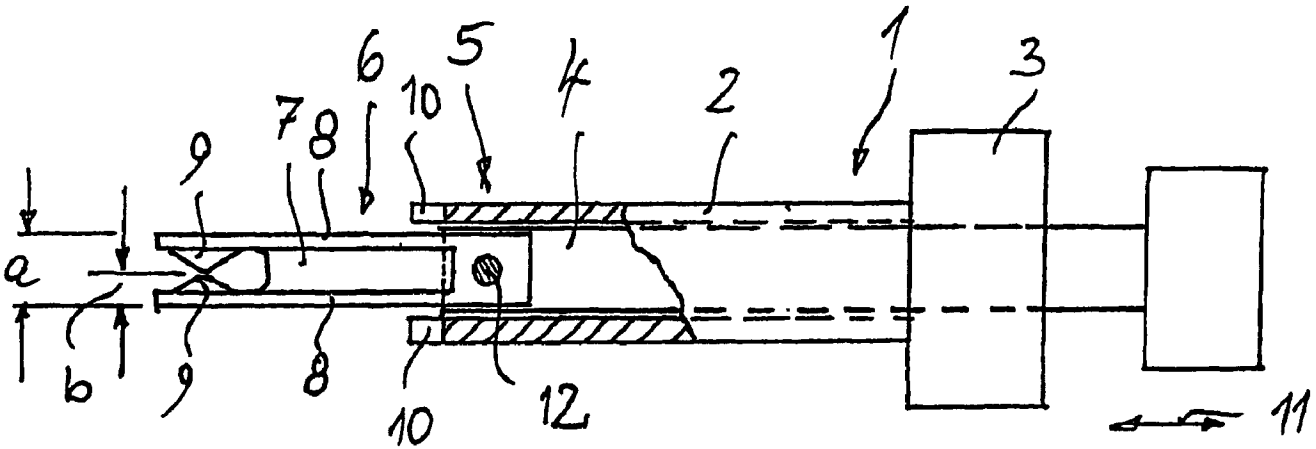
Fig. 1
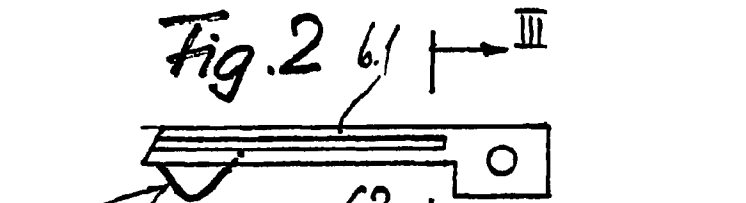
Fig. 2
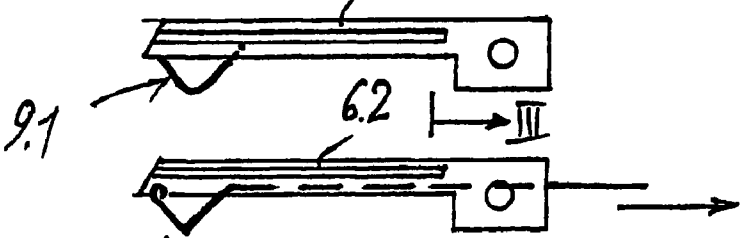
Fig. 3
Fig. 4

TOOL FOR RELEASING A LOCKING CYLINDER

BACKGROUND OF THE INVENTION

The doors of buildings, in particular also the doors of motor vehicles, are nowadays provided with safety locks, meaning the locks have so-called locking cylinders that allow activation of the locking bolts only with the aid of special keys. Until now, access to a room provided with a safety lock of this type in an emergency situation was possible only by destroying the lock, for example by forcefully pulling out the locking cylinder with a pull-out device, as disclosed in references DE-U-87 08 961.0 and DE-U-87 16 770. The amount of time required for this depends on the quality of the lock. However, the lock is destroyed in all cases, so that a new locking cylinder must be inserted. Owing to the fact that so-called locking systems are meanwhile used for locking all the locks in a home as well as a motor vehicle, meaning at least one key can activate all the locks, the remaining locking cylinders generally must also be replaced if one locking cylinder is destroyed.

So-called lock pickers are known for unlocking locks with locking cylinders provided with pin tumblers without destroying these locks. Pickers of this type have a steel blade provided with projections, which is inserted into the keyway. By simultaneously applying a torque with an additional lever tool in opening direction, an attempt is made to push the free ends of the individual pins with the aforementioned blade in the direction counter to the force of a resetting spring and into the closing plane. The respective pins are then held with the lever tool in this position until all pins have been moved to the opened position and the locking cylinder can be turned via the lever tool. This mode of operation is also very time consuming and in practical operations is successful only with locks that have been in use for a long time and have tumbler pins showing a corresponding amount of wear.

Furthermore known are so-called electro-pickers, for which a blade is inserted into the keyway and is moved with the aid of an electro-motor drive, such that it moves with high frequency back and forth inside the keyway plane. Thus, if a torque is applied simultaneously to the locking cylinder in opening direction, as is the case with a manually guided picker, the tumbler pins are moved to the opening plane defined by the periphery of the cylinder. However, this device is non-destructive only to a limited degree since the back and forth beating of the steel blade damages the keyway. The manually guided picker as well as the electro-picker are not suitable for use as so-called tubular or channel-type keyes for unlocking cylinders with wafer tumblers, which must be displaced individually to the opened position, counter to the force of the individual resetting springs and transverse to the cylinder axis.

Such an expenditure of time is not justifiable, for example, in emergency cases where a child or an animal is locked inside a motor vehicle parked in the bright sunlight. The same problem occurs in particular with modem motor vehicles provided with an automatic locking system, which is set to automatically lock, following a predetermined time interval, should the user forget to activate the locking system, even if the doors are only slightly closed. If the user has accidentally left the vehicle keys inside the vehicle, access can be gained only by force and by destroying the locking cylinder or through the time-consuming use of a picker.

Reference DE 198 22 079 C A discloses an unlocking device for locking cylinders, which comprises a tubular rotating body with axial slot that is arranged inside an immovable holding tube with axial key groove. The tumbler is a rod-shaped, loose locking body that is positioned inside the key groove and the slot. Circular supporting wafers are arranged side-by-side inside the rotating body. These wafers hold the rodshaped locking body with their edges inside the key groove of the immovable holding tube and the slot of the rotating body, such that these are positively locked together. The supporting wafers are each provided with a rectangular center opening that forms a keyway in the succession of supporting wafers. The supporting wafers furthermore are provided with edge recesses, positioned differently relative to the respective center openings. If the center openings are aligned in the same direction, the edge recesses are not arranged in a line, one behind the other, and the locking body is held in the locked position. The supporting wafers can be turned simultaneously relative to each other and differing only with the correct key, so that the edge recesses are lined up one behind the other and are positioned under the slot of the rotating body. The cross sectional profile of the locking body in that case is accommodated completely by the slot in the rotating body and the edge recesses of the supporting wafers and the interlocking between immovable holding tube and rotating body is released. Thus, the rotating body provided with a locking nose for the locking mechanism can be turned with the aid of the key.

Whereas with the use of the proper key for the known locking device, the edge recesses of the supporting wafers are aligned in a row during the insertion of the key already and because of correspondingly "encoded" projections, a longitudinally displaceable and rotating wire hook must be inserted into the keyway with the known unlocking device in a holding means. With the aid of this hook, each individual supporting wafer must then be turned by sensing it and its coordination with the locking rod must be felt. Markings on the device specify the thickness of the supporting wafers that form a "stack" to ensure that only one supporting wafer at a time is turned with the hook. One disadvantage is that the hook is not guided while inside the keyway and that a bending and/or twisting of the wire cannot be avoided given the small wire diameter. A built-in microphone in the hook entrance area is designed to support the sensing operation. Thus, even slight movements due to unavoidable production tolerances of the locking rod are detected if the edge recess is positioned under the slot in the rotating body.

A tool of this type cannot be used at all for unlocking a locking cylinder with locking bodies that must be displaced transverse to its rotational axis.

SUMMARY OF THE INVENTION

It is the object of the invention to create a tool for the non-destructive unlocking of a locking cylinder with a tumbler having a plurality of spring-loaded locking bodies, which can be displaced transverse to the rotational axis of the locking cylinder. The tool according to the invention is designed to avoid the above-described disadvantages and make it possible to reliably and with little time expenditure unlock a lock provided with a locking cylinder of this type.

This object is solved with a tool for unlocking a locking cylinder, which tool has certain features. The advantage of the tool according to the invention is that, because the cross-sectional profile of the sensing element is adapted to the cross-sectional profile of the keyway, it is guided almost in the manner of a key inside the keyway. Thus, if the sensing element is moving in axial direction of the locking cylinder, the locking bodies can be moved crosswise thereto and against the force of the resetting spring to the neutral position. That is to say, the free ends of the locking bodies can be moved into the peripheral plane of the rotating part of the locking cylinder. Since the locking cylinder is subjected to a torque in the opening direction or even in the closing direction via the rotating part of the locking cylinder, the individual tumblers are secured in this position. Thus, once the scanning element is completely pulled, the locking cylinder is turned with the rotating part, and the lock can be opened or closed. In this way, it is possible to rescue a child or a dog from a parked vehicle and subsequently lock the vehicle once more.

One embodiment of the invention provides that the sensing body on the sensing element extends in the direction of movement of the locking bodies for the locking cylinder to be opened. The height of the effective component of the sensing body in this case corresponds to the height of the locking body for the locking cylinder to be opened at maximum lift.

The embodiment of the invention provides that the sensing body is arranged on the free end of the sensing element, which allows the sensing element to initially be inserted completely into the keyway. The required torsion can then be generated via the rotating part and the sensing element can subsequently be pulled carefully out of the keyway via the sliding part, if necessary by repeatedly pushing it back and forth with short strokes. In the process, the locking bodies are moved to their opened position.

Depending on the design of the locking cylinder, the sensing body of one embodiment can be connected rigidly to the sensing element, e.g. as is advantageous for channel keys.

According to another embodiment, the sensing body is positioned transverse to the insertion direction of the sensing element, in movement direction of the locking body, and is supported via a supporting spring. A design of this type is suitable for locking cylinders with so-called pin tumblers. For this, the spring rigidity of the supporting spring must be slightly higher than the standard spring rigidity of the resetting springs for the pin-type locking bodies.

Another embodiment of the invention provides that the sensing body is a profiled, springy wire element, which is guided axially displaced on the sliding part. With this embodiment, the sensing element remains inside the keyway and simultaneously functions as rotating part while the displacement movement occurs exclusively via the wire element. The sensing body of this embodiment can be formed easily through bending the wire at the end. The wire sensing body in that case can be guided while mostly supported in the sensing element.

For one useful embodiment of the invention, it is provided that the sensing element is connected detachably to the sliding part. As a result, it is possible to unlock locking cylinders with all different cross-sectional keyway profiles by using a set of adapted sensing elements.

It is furthermore useful if the sensing element is connected with play to the sliding part. As a result, the rotating part and the sliding part, which are considered to be one piece, are uncoupled to some degree. Thus, if a torque is applied via the manually guided rotating part, it does not impose bending moments on the sensing element and this element consequently can be guided without bending moments, and to some degree self-adjusting inside the keyway. It is advantageous in this case if the sensing element is guided practically in the manner of a key owing to its cross-sectional profile that is adapted to the keyway. In the same way, it is advantages if the sliding part on the rotating part can be pivoted slightly around the rotating axis of the rotating part. Otherwise, however, the sensing element is connected form-locking to the sliding part.

Additional embodiments of the invention follow from the dependent claims as well as the subsequently described exemplary embodiment.

BRIEF DESCRIPTION OF THE DRAWINGS

The invention is described further with the aid of exemplary embodiments, which show in:

FIG. 1 A first embodiment of a tool for unlocking a locking cylinder, shown in part as a sectional view.

FIG. 2 A modified embodiment of a sensing element.

FIG. 3 A section through the sensing element, along the line III—III in FIG. 3.

FIG. 4 A different embodiment of a sensing element.

DETAILED DESCRIPTION OF THE PREFERRED EMBODIMENTS

Figure 5:
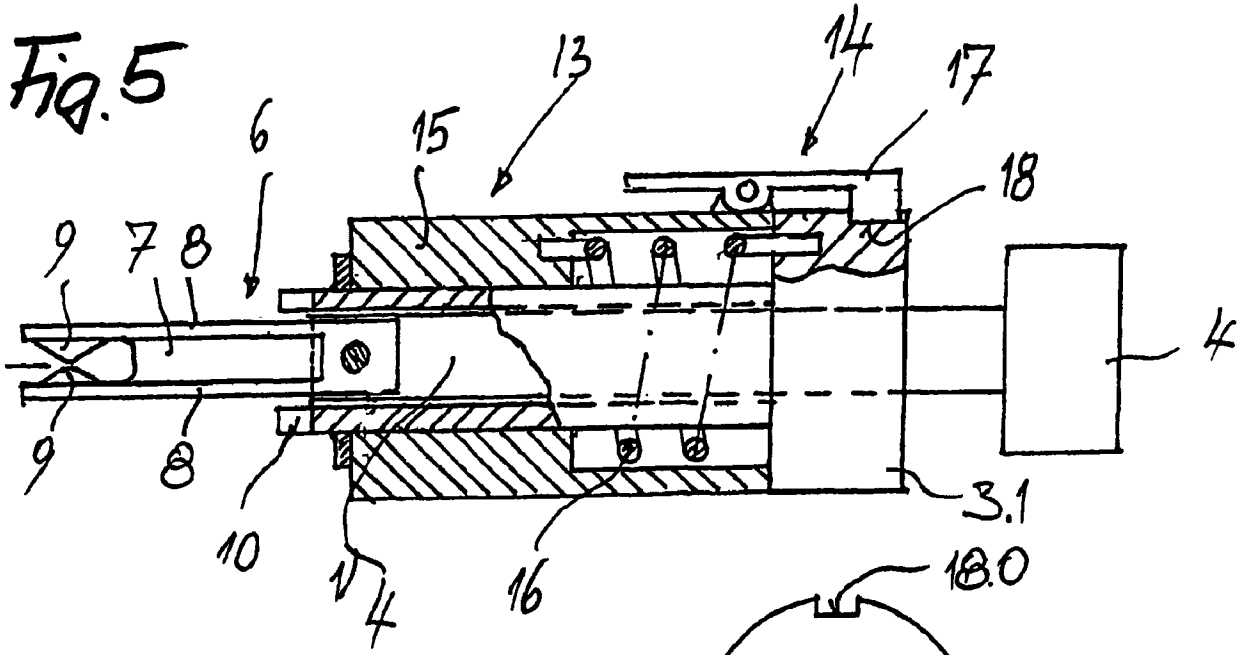
FIG. 5 An embodiment with torque generator, seen in part as longitudinal section.

The tool shown in FIG. 1 for unlocking a locking cylinder comprises a rotating part 1, which essentially consists of a tubular extension 2 with a gripping element 3 on the end. A sliding part 4 is guided inside the tubular extension 2 in such a way that it can be displaced in longitudinal direction, wherein the sliding part is connected on its cylinder-side end 5 to a sensing element 6. The cross-sectional profile of the sensing element corresponds at least in some sections to the cross-sectional profile of the keyway for the locking cylinder to be unlocked. The sensing element 6 for the exemplary embodiment shown herein is designed for unlocking locking cylinders for channel keys with wafer tumblers. For this, the sensing element 6 has a grooved area 7 milled into both flat sides, which is limited on both narrow sides by webs 8. The height a corresponds approximately to the height of the associated key while the thickness of the sensing element in the region of web 8 corresponds approximately to the thickness of the key.

At its free end, the sensing element 6 is provided with triangular sensing bodies 9, which are arranged offset to each other with respect to the thickness of the sensing element. The effective height b of the sensing bodies—respectively measured starting from one longitudinal side—corresponds to the locking element height at maximum lift.

The tubular extension 2 is provided on the cylinder side end with two driver noses 10, which can be inserted into the keyway of the locking cylinder to be unlocked and have a thickness that corresponds approximately to the thickness of the sensing element 6.

For the unlocking operation with pulled-back sensing element 6, the extension with its two driver noses 10 and the sensing element 6 is inserted into the keyway in the direction of arrow 11 by displacing the sliding part 4. A torque is then exerted manually via the gripping element 3 and the driver noses 10 onto the locking cylinder, which is still locked through its tumbler elements, so that the locking cylinder is pressed against the locked tumbler elements inside the locking cylinder. Subsequently, the sliding part 4 is pulled back slowly, so that the individual tumbler elements of the locking cylinder are successively moved to the neutral position. The locking cylinder is completely unlocked following a complete pull-back of the sensing element and the respective door can be opened by turning the locking cylinder in the opening direction while maintaining the torque via the gripping element 3.

For locking cylinders with pin tumblers, it is useful if the sensing element 6.1 corresponds over a section of its height, meaning the edge height facing away from the tumblers, to a section of the cross-sectional profile of the keyway, as shown in FIG. 2. With this embodiment, a sensing body 9.1 in the form of a spring steel yoke is arranged at the free end of the sensing element 6, which yoke is positioned relatively displaceable on the sensing element 6.1, at least on one end. The spring hardness of the spring steel yoke is adjusted such that its resilience is lower than the resilience of the tumbler pins supported by springs. The mode of activation is the same as described with the aid of FIG. 1.

FIG. 3 schematically shows an exemplary cross section through the sensing element along the line III—III in FIG. 2, which illustrates that its cross section is adapted to a cross section of a keyway. Correspondingly adapted sensing elements must be used for different keyway shapes.

In place of the described resilient yoke shown in FIG. 2, the sensing body 9.1 can also be used as sensing body that is spring-supported and can be displaced relative to the sensing element.

The embodiment shown in FIG. 4 is a modification of the embodiment shown in FIG. 2. The embodiment comprises a wire element with one end shaped as a yoke, which functions as sensing body on a sensing element 6.2, e.g. with a cross-sectional shape shown in FIG. 3, which can be displaced in longitudinal direction. The sensing element of this embodiment can be connected directly to a gripping element, which is inserted into the keyway together with the wire element 9.2 and is subjected inside this keyway to a torque. The wire element 9.2 is then pulled back slowly, so that the unlocked locking cylinder can be turned, following an unlocking movement of the tumbler pins via the yoke-shaped sensing body 9.2 with the aid of the sensing element 6.2. Thus, it is possible to turn the unlocked locking cylinder of the associated lock to the open position.

FIG. 1 shows that it is useful if the tool is provide with replaceable sensing elements 6, which are connected with a screw 12, for example, to the sliding part 4. A certain amount of play between the sensing element 6 and the sliding part 4 is advantageous. This play ensures a slight pivoting around the axis and crosswise to the axis of screw 12, as well as a certain mobility of the sensing element 6 relative to the sliding part 12. The sliding part 4 is positioned inside the rotating part 1 in such a way that it can be displaced not only in the longitudinal direction, in the direction of arrow 11, but also has a certain amount of play in the rotational direction of the rotating part 1. This is designed to avoid bending moments between the sensing element 6 and the sliding part or the rotating part. Otherwise, the rotating part 1 and the sliding part 4 are fixed to one another.

The sliding part 4, which is advantageously also provided with a gripping element 13[sic], can be designed such that an electric drive element, e.g. supplied via a storage battery, can be connected, which generates a periodic back and forth movement of the sensing element 6 with slight lift. The design simultaneously permits a pulling out of the sliding part 4 together with the back and forth moving sensing element 6.

FIG. 5 shows the embodiment according to FIG. 1, but "retrofitted" according to the invention with a rotary force generator 13, which can be connected to the rotating part 2[sic] via a locking mechanism 14 that can be released. The rotary force generator 13 primarily consists of a handling part 15, in which the rotating part 2[sic] is positioned rotating. The handling part 15 and the rotating part 2[sic] are connected via a spring element 16, for example a flat spiral spring.

Figure 6:
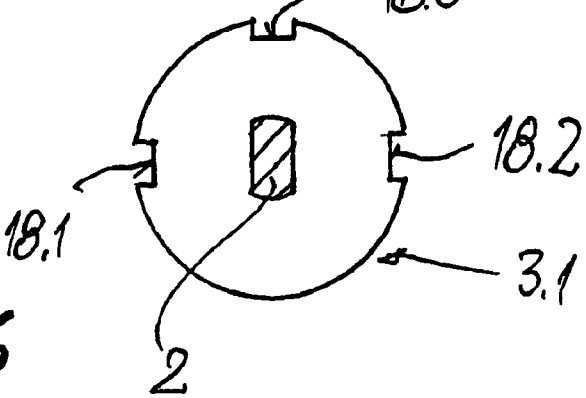
FIG. 6 A frontal view in the direction of arrow A in FIG. 5.

The locking mechanism 14, shown only schematically herein, is provided with a locking element 17, positioned on the handling part 15, to which several catches 18.0, 18.1 and 18.2 are assigned on the head 3.1 of rotating part 2[sic] (FIG. 6). In the position where the catch 18.0 is engaged, the spring element 16 is not tensioned. The tool can be handled via the holding element 15[1], as described for the embodiment according to FIG. 1. For the practical conversion, it makes sense if the locking element 17 on the handling part 15 is turned to prevent an unwanted triggering of the torque intensifier during the activation of the sensing element. For example, this can be realized with locking elements that are effective in axial direction and can be activated only from the front, wherein the catches 18 must be adapted correspondingly. However, with locking cylinders having particularly easy-moving locking bodies, the rotational speed achieved through manual activation is not sufficient to turn the locking cylinder in opening and closing direction following the adjustment of the locking bodies. Even with a slight change in the manually applied torque, the locking bodies will move back to the locked position under the effect of their resetting springs.

[1]Note: Handhabungsteil 15=handling part 15; Haltelement 15=holding element 15

Depending on the desired rotational direction (opening or closing), the spring element 16 is pre-tensioned before the tool is attached to the locking cylinder by turning the handling part 15 relative to the rotating part 2[sic]. The spring element is locked in the end position predetermined by the catches 18.1 or 18.2, so that the torque generator 13 is pre-tensioned. The locking with catch 18.1 causes a pre-tensioning for generating a rotational force in opening direction and the locking with catch 18.2 correspondingly generates a rotational force in closing direction.

The angle position for catches 18.1 and 18.2 relative to the catch 18.0, which is 90 degrees in this case, can be selected differently, depending on the requirements. It may be advantageous to provide for each rotational direction several catches 18.1 or 18.2 at different angle positions, relative to catch 18.0, thus making it possible to select different rotational distances for the locking cylinder to be opened.

As described with the aid of FIG. 1, the tool is again used to adjust the locking bodies of the locking cylinder. The necessary "clamping force" for holding the individual locking bodies in the opened positioned adjusted by the sensing bodies 9 is generated via the handling part 15 and the noses 10 on the rotating part 2[sic]. As soon as all locking bodies are in the opened position, the locking mechanism 14 is released, so that the rotating part 2[sic] turns in the direction predetermined by the pre-tensioning of the spring element 16. As a result of the noses 10 that are inserted into the keyway, the rotating part turns with high rotational speed, so-to-speak abruptly. In the process, the sensing element with a cross section that corresponds to the cross section of the respective key can also be inserted completely into the keyway and can support the rotational movement. The handling part 15 must then be held manually and, if necessary, supported with an additional support at the door, such that it cannot turn. As a rule, it is sufficient if a hand is placed onto the handle of the door to be opened.

What is claimed is:

1. A tool for unlocking a locking cylinder, provided with a tumbler having a plurality of spring-loaded locking bodies, which can be displaced crosswise to the rotational axis of the locking cylinder, said tool comprising a rotating part that is provided on its cylinder side end with two driver noses, which can be inserted into the keyway, further provided with a sliding part that is locked to the rotating part in a rotational direction, but axially movable in an axial direction, and is provided on its cylinder-side end with a flat sensing element for insertion into the keyway, which sensing element has a cross-sectional profile of axial extension corresponding at least in some areas to the cross-sectional profile of the keyway and to which is assigned at least one sensing body for displacing the locking bodies inside the locking cylinder.

2. A tool according to claim 1, characterized in that the sensing body is arranged on the free end of the sensing element.

3. A tool according to claim 1, characterized in that the sensing body is rigidly connected to the sensing element.

4. A tool according to claim 1, characterized in that the sensing body is positioned on the sensing element, such that it can be moved crosswise to the sliding direction and is supported by a supporting spring.

5. A tool according to claim 1, characterized in that the sensing body (9.1) is a profiled, springy sensing element (9.2,) which is guided axially displaceable on the sensing element.

6. A tool according to claim 1, characterized in that the sensing element is connected detachable to the sliding part.

7. A tool according to claim 1, characterized in that the sensing element is connected with play to the sliding part.

8. A tool according to claim 1, characterized in that the sliding part is positioned on the rotating part, such that it can be pivoted slightly around the rotational axis of the rotating part.

9. A tool according to claim 1, characterized in that the sliding part is guided so as to be axially displaceable inside a tubular extension on the rotating part.

10. A tool according to claim 9, characterized in that the driver noses are arranged at the free end of the tubular extension.

11. A tool according to claim 10, characterized in that the end of rotating part (1) that is facing away from the driver noses (10) is connected to a gripping element.

12. A tool according to claim 1, characterized in that the sensing element is positioned such that it can be moved back and forth inside the sliding part and is connected to a drive element for generating a periodic back and forth movement.

13. A tool according to claim 1, characterized in that a handling part is provided, on which the rotating part is positioned rotating and with which it can be locked in place non-rotating with the aid of a releasable locking mechanism and that a spring element that can be tensioned between the handling part and the rotating part is provided for generating a rotational force that is effective between the handling part and the rotating part.

14. A tool according to claim 13, characterized in that the spring element can be pre-tensioned relative to both rotational directions of the rotating part.

15. A tool according to claim 14, characterized in that the spring element is designed as a flat coiled spring.

* * * * *

UNITED STATES PATENT AND TRADEMARK OFFICE

CERTIFICATE OF CORRECTION

PATENT NO. : 6,931,898 B2
DATED : August 23, 2005
INVENTOR(S) : Adalbert Wendt

It is certified that error appears in the above-identified patent and that said Letters Patent is hereby corrected as shown below:

Title page,
Insert Item -- [30] Foreign Application Priority Data
September 30, 2000 DE 200 16 866.5 --.

Signed and Sealed this

Twenty-third Day of May, 2006

JON W. DUDAS
*Director of the United States Patent and Trademark Office*